US009032943B1

(12) United States Patent
Coalson et al.

(10) Patent No.: US 9,032,943 B1
(45) Date of Patent: May 19, 2015

(54) UNIVERSAL WRIST STRAP FOR ARCHERY BOWSTRING RELEASE

(71) Applicant: TruGlo, Inc., Richardson, TX (US)

(72) Inventors: Damon Coalson, Dallas, TX (US); John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 59 days.

(21) Appl. No.: 13/734,720

(22) Filed: Jan. 4, 2013

(51) Int. Cl.
*F41B 5/18* (2006.01)
*F41B 5/14* (2006.01)

(52) U.S. Cl.
CPC ..... *F41B 5/148* (2013.01); *F41B 5/1469* (2013.01)

(58) Field of Classification Search
USPC ..... 124/35.2
See application file for complete search history.

(56) References Cited

U.S. PATENT DOCUMENTS

| | | | | |
|---|---|---|---|---|
| 5,357,939 | A | | 10/1994 | Tentler et al. |
| 5,448,983 | A | | 9/1995 | Scott |
| 5,595,167 | A | | 1/1997 | Scott |
| 5,596,977 | A | | 1/1997 | Scott |
| 5,615,662 | A | | 4/1997 | Tentler et al. |
| 5,653,214 | A | * | 8/1997 | Lynn ..... 124/35.2 |
| 5,765,536 | A | | 6/1998 | Scott |
| 5,857,452 | A | | 1/1999 | Troncoso |
| 7,278,415 | B2 | | 10/2007 | Jones |
| 7,753,043 | B1 | | 7/2010 | Eckert |

* cited by examiner

*Primary Examiner* — John Ricci
(74) *Attorney, Agent, or Firm* — Alvin R. Wirthlin

(57) ABSTRACT

A universal wrist strap, for connection to a plurality of different bowstring release mechanisms via a plurality of different connecting members, includes a flexible base member adapted to fit around the wrist of a user and a mounting assembly connected to the wrist strap. The flexible base member has first and second arms that converge towards an apex area. The mounting assembly is connected to the apex area and is adapted to receive and retain the plurality of different connecting members.

18 Claims, 6 Drawing Sheets

UNIVERSAL WRIST STRAP FOR ARCHERY BOWSTRING RELEASE

BACKGROUND OF THE INVENTION

This invention relates generally to archery equipment, and more particularly to a wrist strap adaptable to a variety of different connectors associated with different bowstring release mechanisms.

Many accessories for archery bows are available for facilitating bow handling, stabilizing the bow during use, improving aiming accuracy, and so on. Once such accessory is in the form of a wrist strap with an attached bowstring release. Archery bowstrings of compound bows typically have pull forces on the order of about 40 to 90 pounds. The use of wrist straps has become common to accommodate these large forces which have the potential to cause possible injury to the archer's fingers. A wrist strap removes the force of the bowstring that would otherwise be present on the fingers and spreads the force over a relatively large surface area of the wrist and the back of the archer's hand while leaving at least the thumb or index finger of the hand free to activate the trigger mechanism of the bowstring release.

Since the hands and wrists of archers come in many different shapes and sizes, wrist straps and their accompanying string release mechanisms are typically adjustable to accommodate as many archers as possible. Various prior art solutions for connecting the bowstring release mechanism to the wrist strap can be found in U.S. Pat. Nos. 7,753,043, 7,278,415, 5,596,977, 5,595,167, and 5,448,983 the disclosures of which are hereby incorporated by reference. Such solutions have different connecting arrangements between a particular bowstring release mechanism and a particular wrist strap, and therefore are not interchangeable. When a wrist strap and/or bowstring release mechanism of the prior art breaks or becomes worn or otherwise unsuitable for use, and due to the different connecting arrangements of each solution, the user was required to purchase a new replacement part from the original manufacturer or purchase a new wrist strap with attached bowstring release from another manufacturer. For example, if the wrist strap became worn or broken, the user would be required to purchase a new wrist strap to go with the remaining useful parts, such as the bowstring release mechanism, due to the unique connection arrangement between the wrist strap and release mechanism. If it was desirous to change out the old worn or broken wrist strap for another wrist strap that was more suitable to the user's preference, the user would have to purchase the desired wrist strap with a new release mechanism. In this instance, the release mechanism may not be preferred by the user. Until the present invention, there has been no provision in the prior art to replace a worn or broken wrist strap with a more suitable wrist strap for the user independent of the type of release mechanism being used.

Accordingly, it would be desirous to provide a universal wrist strap that is adaptable to various different connecting arrangements between the bowstring release mechanism and wrist strap.

SUMMARY OF THE INVENTION

In accordance with one aspect of the invention, a universal wrist strap, for connection to a plurality of different bowstring release mechanisms via a plurality of different connecting members, includes a flexible base member adapted to fit around the wrist of a user and a mounting assembly connected to the wrist strap. The flexible base member has first and second arms that converge towards an apex area. The mounting assembly is connected to the apex area and is adapted to receive and retain the plurality of different connecting members.

In accordance with a further aspect of the invention, a method of replacing a worn or broken wrist strap of a bowstring release assembly includes providing a universal wrist strap with a mounting assembly having an upper mounting portion connectable to a lower mounting portion; removing the connecting member and bowstring release mechanism from the worn or broken wrist strap; installing the connecting member on the lower mounting portion; and connecting the upper mounting portion to the lower mounting portion such that the connecting member is captured and retained in the mounting assembly.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
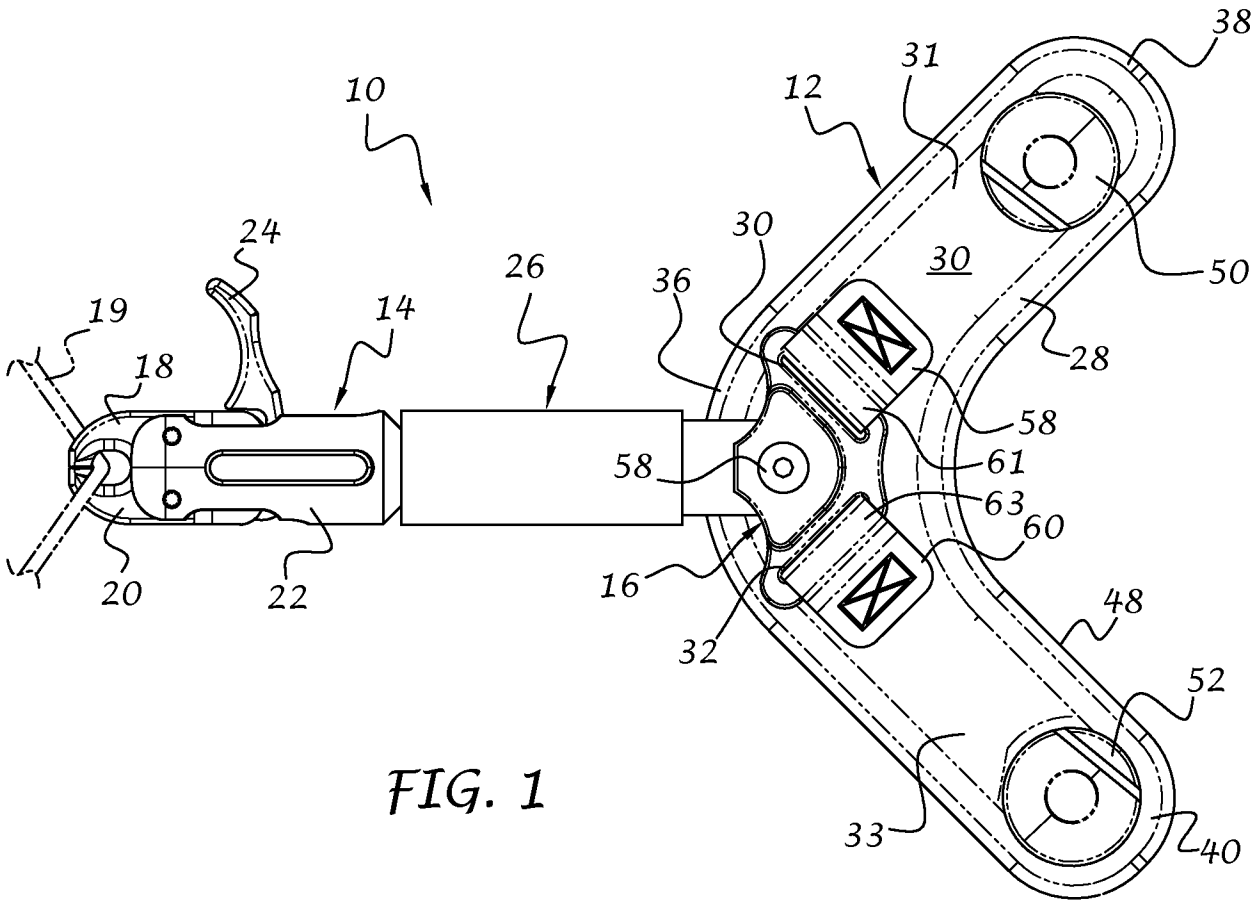
FIG. 1 is a top plan view of a bowstring release assembly with a bowstring release mechanism connected to a universal wrist strap in accordance with the present invention.

Referring now to the drawings, and to FIG. 1 in particular, a bowstring release assembly 10 in accordance with the invention is illustrated. The assembly 10 includes a bowstring release mechanism 14 removably connected to a universal wrist strap 12 via a mounting assembly 16 in accordance with the present invention. The bowstring release mechanism 14 extends from the wrist strap 12 via an extension member 26 for engaging a bowstring and/or a string loop or "D" loop 19 associated with the bowstring. The present invention is primarily adapted for use with compound bows due to the high pull forces that otherwise may injure the fingers of an archer, but may also be used with recurve bows, reflex bows, longbows, and so on.

The jaw mechanism 14 as shown is of conventional construction and includes a pair of jaws 18, 20 that extend outwardly from a body portion 22. A trigger 24 also extends from the body portion 22 and is operatively associated with one or both jaws such that, when the trigger 24 is pulled, movement of one or both jaws toward an open position occurs, to either release the bowstring or string loop when shooting, or allow entry of the bowstring or string loop into the center of the jaws when getting ready to assume a shooting stance. Likewise, pushing the trigger 24 in the opposite direction causes movement of one or both jaws from the open position toward the closed position to encircle or capture the bowstring or string loop 20. The internal components that permit operation of the jaw mechanism 14 in the above-described manner are well known and therefore will not be further described.

An extension member 26 is connected to the jaw mechanism 14 and the wrist strap 12 via the mounting assembly 16. The extension member 26 can be adjustable in any well known-manner for accommodating the different hand sizes and preferences of archers so that a proper shooting position can be achieved. It will be understood that other jaw mechanisms and/or trigger devices can be used without departing from the spirit and scope of the invention.

Figure 6:
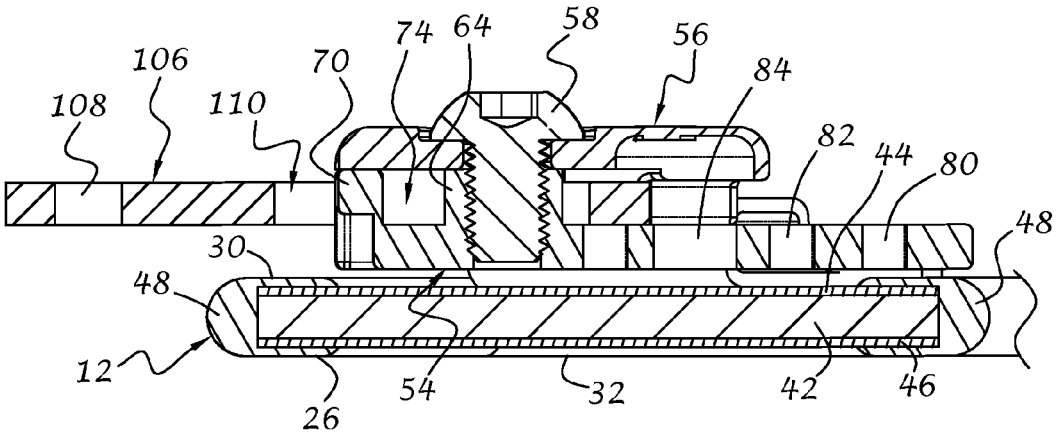
FIG. 6 is a sectional view thereof taken along line 6-6 of FIG. 5 with the upper clamping portion installed on the lower clamping portion.

A preferred wrist strap 12 for use with the mounting assembly 16 of the present invention is illustrated in FIGS. 1 and 6. The wrist strap 12 preferably includes a flexible base member 28 that is adapted to at least partially surround the wrist of an archer. The base member 28 is preferably generally V-shaped in construction with a first arm 31 and a second arm 33 converging at an apex portion 36. The base member 28 has a top surface 30 and bottom surface 32 (FIG. 6), an apex portion 36, and a first end portion 38 associated with the first arm 31, and a second end portion 40 associated with the second arm 33, that diverge from the apex portion 36. It will be understood that the term "end portion" as used herein can include any portion of the flexible base member up to the apex portion. Preferably, the flexible base member 28 is constructed of a center padding layer 42 (FIG. 6), an upper lining layer 44, and a lower lining layer 46 that have the same shape as the center layer 42. The center layer, upper layer and lower layer are preferably connected together via a continuous edging 48 that extends around the periphery of the base member and wraps around the edge thereof so that a portion of the edging is positioned on the top surface 30 and bottom surface 32. The edging 48 is preferably connected to the layers by stitching. However, it will be understood that other means for connecting the layers together can be used without departing from the spirit and scope of the invention. The upper and lower layers can be used to add strength to the center layer and can be of any color or pattern, such as various camouflage patterns, to thereby provide both functional and aesthetically pleasing effects. However, it will be understood that the base member 26 can be constructed of a single layer of material or, alternatively, more than three layers of material, without departing from the spirit and scope of the invention.

An adjustment mechanism is connected to the flexible base member 26 for cinching the wrist strap 12 around the wrist of a user with virtually infinite adjustment. The adjustment mechanism preferably includes a first anchor member 50 connected to the top surface 30 of the flexible base member 26 at or near the first end portion 38 of the base member, and a second anchor member 52 connected to the top surface 30 at or near the opposite second end portion 40 of the base member 26, and a cable (not shown) that extends between the first and second anchor members. The first anchor member is preferably in the form of a reel assembly for winding and unwinding the cable while the second anchor member 52 serves to hold a loop of the cable during winding and unwinding.

Further details of the wrist strap 12 are described in copending U.S. application Ser. No. 13/314,330 to Anthony T. LoRocco and assigned to TruGlo Inc., the disclosure of which is hereby incorporated by reference. It will be understood that the present invention is not limited to the particular wrist strap shown and described, as the mounting assembly of the present invention is adaptable to a wide variety of wrist strap types, styles, and sizes.

Figure 2:
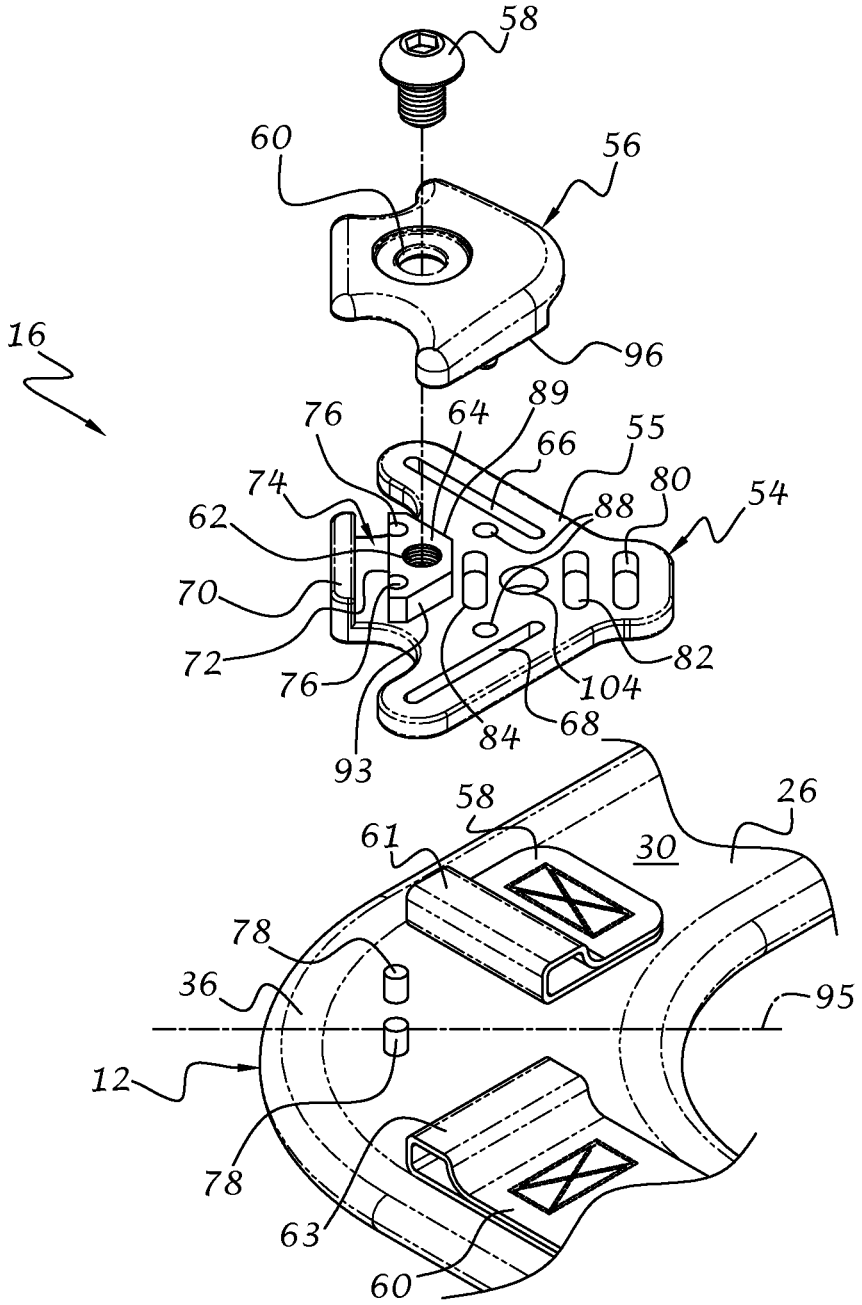
FIG. 2 is an isometric exploded view of a mounting assembly of the universal wrist for connecting the universal wrist strap to a variety of different bowstring release mechanisms.

As best shown in FIG. 2, the mounting assembly 16 preferably includes a first lower mounting portion 54 connected to the wrist strap 12 and a second upper mounting portion 56 for connection to the lower mounting portion 54. As shown, a fastener 58, preferably in the form of a threaded screw, extends through an opening 60 formed in the upper mounting portion 56 and threads into an opening 62 formed in a lower mounting block 64 of the lower mounting portion 54.

The lower mounting portion 54 is preferably in the form of a generally triangular-shaped lower plate 55 and is attached to the top surface 30 of the base member 26 at the apex portion 36 thereof via a pair of bands or straps 61 and 63 that extend through strap mounting slots 66 and 68, respectively, formed in the plate 55. The slots 66 and 68 are preferably oriented perpendicular to a longitudinal extension of the first and second arms 31 and 33, respectively. The bands 61 and 63 are preferably looped or folded over and the superimposed ends of each band are secured to the base member 26 of the wrist strap 12, preferably through stitching, to thereby create loop portions that extend through the slots 66, 68. However, it will be understood that other means for attaching the lower mounting portion 54 to the base member 26 can be used, including but not limited to, adhesive bonding, clamping, mechanical fastening, and so on.

The lower mounting portion 54 further includes a front wall 70 spaced from a front surface 72 of the lower mounting block 64 to form a locating groove 74 for receiving various connecting members for the string release mechanism, as will be described in greater detail below. Locating grooves 76 are formed in the front surface 72 of the mounting block 64 for receiving spaced locating pins 78 that extend from the base member 26 so that the lower mounting portion 54 can be properly placed with respect to the base member. The locating pins 78 are preferably in the form of cylindrically-shaped resilient inserts for reducing vibration and/or rattling of various connecting members when installed in the locating groove 74, as will be described in greater detail below. A series of transverse slots 80, 82, and 84 are formed in the lower mounting portion 54 for receiving a leash 86 (FIG. 4) associated with a string release mechanism, such as mechanism 14 in FIG. 1. The slots 80, 82 and 84 are preferably parallel with the front wall 70 so that the leash 86 extends in the proper orientation with respect to the wrist strap 12. Locating apertures 88 preferably extend through the plate 55 for receiving locating pins 90 (FIG. 3) formed on the upper mounting portion 56 so that the upper mounting portion is properly oriented with respect to the lower mounting portion. The lower mounting block 64 preferably includes rear-facing angled surfaces 89 and 93 that extend at an acute angle with respect to a centerline 95 bisecting the apex portion 36. Although the lower mounting block 64 is generally triangular in shape, it can be semi-circular, circular, or of some other shape for accommodating various connecting members, without departing from the spirit and scope of the invention.

Figure 3:
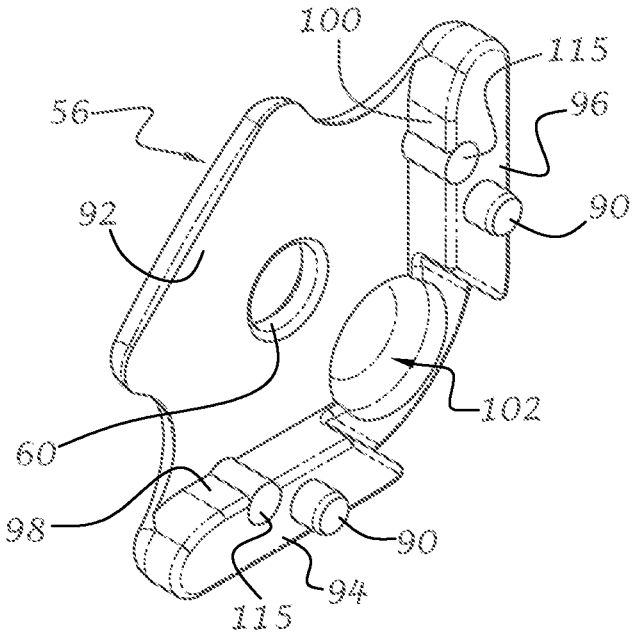
FIG. 3 is a lower isometric view of an upper clamping portion associated with the mounting assembly of FIG. 2.

As best shown in FIG. 3, the upper mounting portion 56 preferably includes an upper plate 92 with a first upper mounting block 94 and second upper mounting block 96 extending downwardly therefrom. The locating pins 90 in turn extend downwardly from each mounting block. Preferably, the first and second upper mounting blocks 94 and 96 are oriented parallel with the mounting slots 66 and 68 (FIG. 2), respectively, of the lower mounting portion 56. The mounting blocks 94 and 96 have inner surfaces 98 and 100, respectively, that generally face forward that, together with the mounting block 64 (FIG. 2) of the lower mounting portion 54, capture various connecting members associated with the string release mechanism to thereby positively connect the string release mechanism to the wrist strap 12. The upper mounting blocks preferably include angled surfaces 98 and 100 that extend at an acute angle with respect to the centerline 95 (FIG. 2) bisecting the apex portion 36. Although the upper mounting blocks form a generally triangular-shaped opening for accommodating the lower mounting block 64, they can be semi-circular, circular, or of some other shape for accommodating various connecting members, without departing from the spirit and scope of the invention. A circular depression 102 is formed in the top plate 92 of the upper mounting portion 56 and is in alignment with an opening 104 formed in the bottom plate 55 for receiving a connection member, such as a fastener assembly, associated with the release mechanism.

Figure 4:
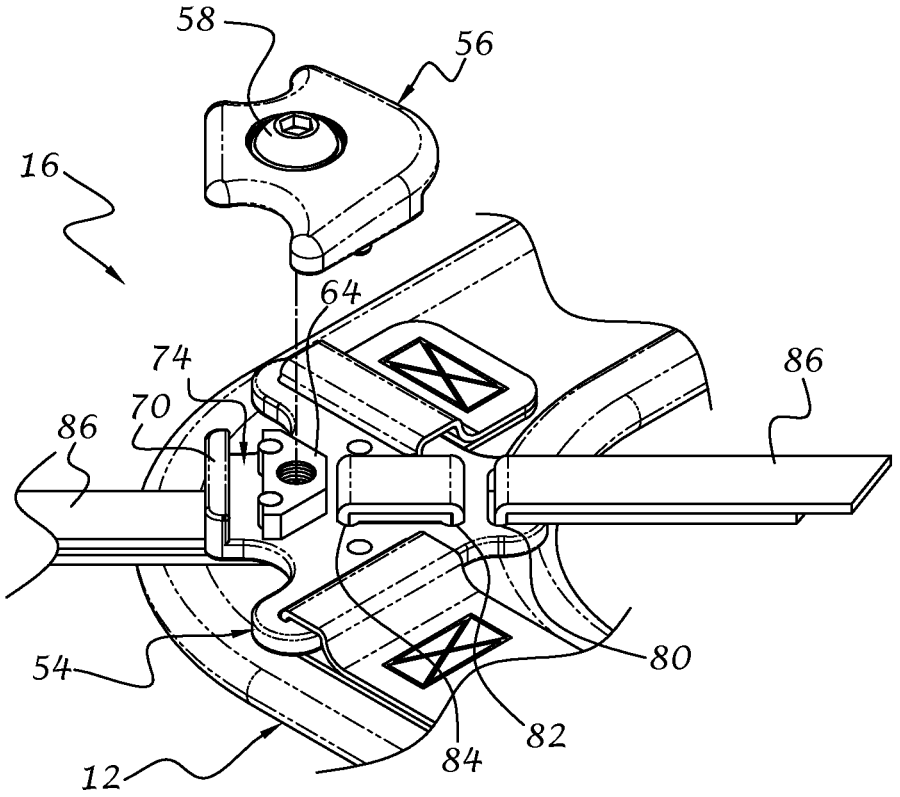
FIG. 4 is a partially exploded isometric view of the a portion of a first bowstring release mechanism connectable to the universal wrist strap via the mounting assembly in accordance with the invention.

Referring now to FIG. 4, a portion of a prior art connecting member 86 associated with a bowstring release mechanism, such as mechanism 14 in FIG. 1, is connected to the wrist strap 12 in accordance with the invention. As shown and as previously described, the connecting member 86 is in the form of a connecting strap that extends through the strap connecting slots 80, 82, and 84 formed in the lower mounting portion 54. The provision of three such slots ensures that the strap is securely held in place under high tensile forces that are generated while the bowstring of an archery bow is being pulled back to the drawn position. However, it will be understood that more or less slots or other strap securing arrangements can be used without departing from the spirit and scope of the invention. When the connecting member 86 is installed on the lower mounting portion 54 as shown, neither the block 64 nor the groove 74 are used for retaining the strap, nor is the upper mounting portion used for capturing a portion of the strap for the purpose of connecting the strap 86 to the wrist strap 12.

Figure 5:
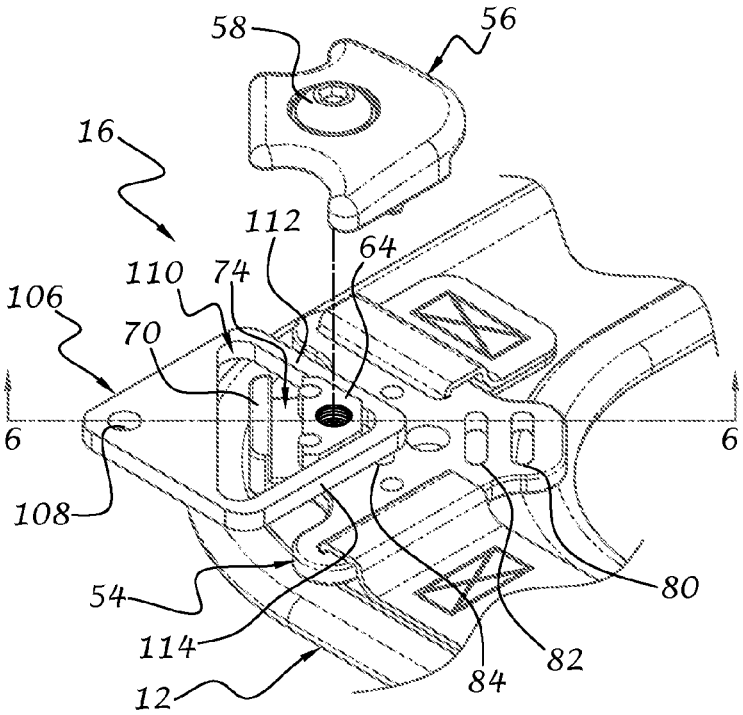
FIG. 5 is a partially exploded isometric view of the a portion of a second bowstring release mechanism connectable to the universal wrist strap via the mounting assembly in accordance with the invention.

Referring now to FIGS. 5 and 6, another prior art connecting member 106 associated with a bowstring release mechanism, such as mechanism 14 in FIG. 1, is connected to the wrist strap 12 in accordance with the invention. As shown, the connecting member 106 is formed as a flat plate with a forward aperture 108 extending therethrough for connection to an extension member (not shown) associated with the release mechanism, and a rearward triangular-shaped opening 110 that form support legs 112 and 114. When the connecting member 106 is installed on the wrist strap 12, the rear opening 112 captures the lower mounting block 64 and front wall 70 of the lower mounting portion 54 such that the support legs 112 and 114 are in contact with the rear-facing angled surfaces 89 and 93 of the lower mounting block 64. The upper mounting portion 56 is then secured to the lower mounting portion 54, as previously described, so that the support legs 112 and 114 are captured between the first and second upper mounting blocks 94 and 96 and the lower mounting block 64, as well as the lower plate 55 and upper plate 92. Preferably, the upper mounting blocks include resilient inserts 115 (FIG. 2) that are compressed against the support legs 112 and 114 when installed to reduce or eliminate vibration or rattling that may otherwise occur. In this manner, the prior art connecting member 106 and its associated extension member and/or string release mechanism can be re-used when the user's worn or broken wrist strap is replaced with the wrist strap 12 or the like having the mounting assembly 16. When the connecting member 106 is installed on the lower mounting portion 54 as shown, neither the locating groove 74, nor the strap connecting slots 80, 82, and 84, are used for retaining the connecting member 106 for the purpose of connecting the connecting member 106 to the wrist strap 12.

Figure 7:
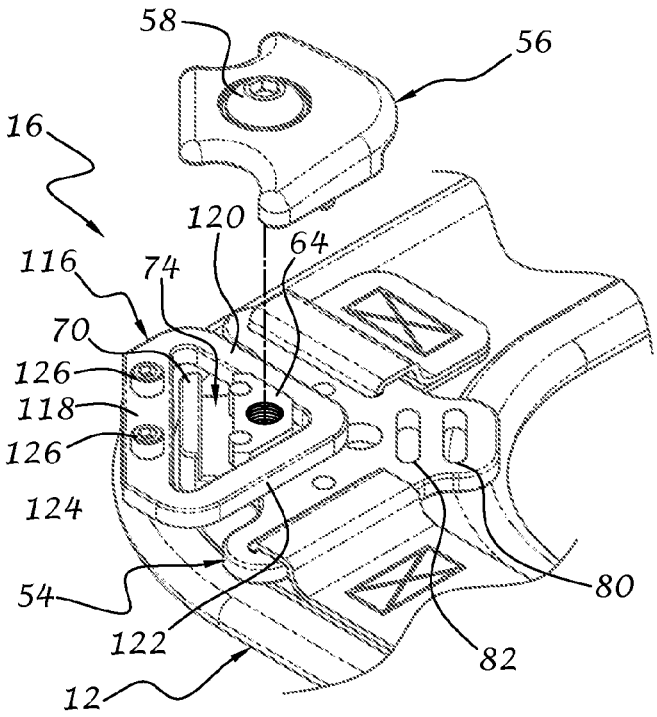
FIG. 7 is a partially exploded isometric view of the a portion of a third bowstring release mechanism connectable to the universal wrist strap via the mounting assembly in accordance with the invention.

Referring now to FIG. 7, a prior art connecting member 116 associated with a bowstring release mechanism, such as mechanism 14 in FIG. 1, is connected to the wrist strap 12 in accordance with the invention. As shown, the connecting member 116 is generally triangular in shape and formed as a flat plate with a forward transverse arm 118 and two rearwardly converging support legs 120, 122 extending from the forward arm to form a triangular-shaped opening 124. Fasteners 126 are located in the forward arm 118 and thread into a clamping plate (not shown) or the like for holding a band, strap or the like associated with the trigger release mechanism in a well-known manner. When the connecting member 116 is installed on the wrist strap 12, the triangular-shaped opening 124 captures the lower mounting block 64 and front wall 70 of the lower mounting portion 54 such that the support legs 120 and 124 are in contact with the rear-facing angled surfaces 89 and 93 of the lower mounting block 64. The upper mounting portion 56 is then secured to the lower mounting portion 54, as previously described, so that the support legs 120 and 122 are captured between the first and second upper mounting blocks 94 and 96 and the lower mounting block 64, as well as the lower plate 55 and upper plate 92. In this manner, the prior art connecting member 116 and its associated extension member and/or string release mechanism can be re-used when the user's worn or broken wrist strap is replaced with the wrist strap 12 or the like having the mounting assembly 16. When the connecting member 116 is installed on the lower mounting portion 54 as shown, neither the locating groove 74, nor the strap connecting slots 80, 82, and 84, are used for retaining the connecting member 106 for the purpose of connecting the connecting member 106 to the wrist strap 12.

Figure 8:
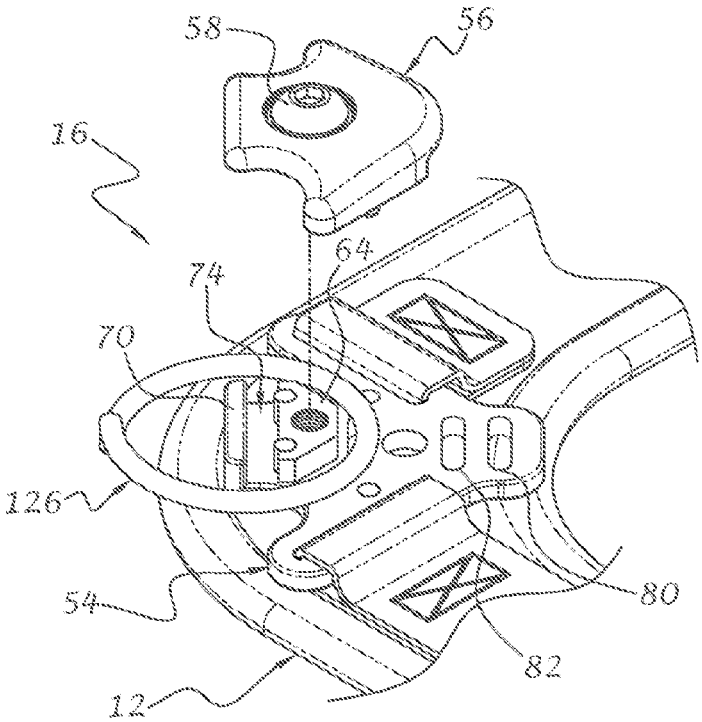
FIG. 8 is a partially exploded isometric view of the a portion of a fourth bowstring release mechanism connectable to the universal wrist strap via the mounting assembly in accordance with the invention.

Referring now to FIG. 8, a prior art connecting member 126 associated with a bowstring release mechanism, such as mechanism 14 in FIG. 1, is connected to the wrist strap 12 in accordance with the invention. As shown, the connecting member 126 is in the form of a split ring that receives a band, strap or the like associated with the trigger release mechanism in a well-known manner. When the connecting member 126 is installed on the wrist strap 12, the ring captures the lower mounting block 64 and front wall 70 of the lower mounting portion 54 such that the inner surface of the ring are in contact with the mounting block 64. The upper mounting portion 56 is then secured to the lower mounting portion 54, as previously described, so that the connecting member 126 is captured between the first and second upper mounting blocks 94 and 96 and the lower mounting block 64, as well as the lower plate 55 and upper plate 92. In this manner, the prior art connecting member 126 and its associated extension member and/or string release mechanism can be re-used when the user's worn or broken wrist strap is replaced with the wrist strap 12 or the like having the mounting assembly 16. When the connecting member 126 is installed on the lower mounting portion 54 as shown, neither the locating groove 74, nor the strap connecting slots 80, 82, and 84, are used for retaining the connecting member 116 for the purpose of connecting the connecting member 116 to the wrist strap 12.

Figure 9:
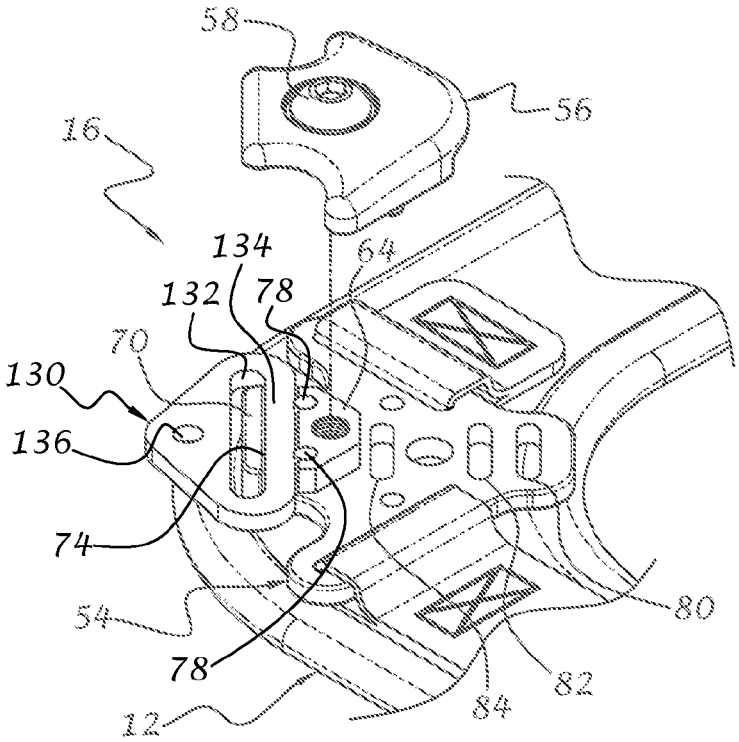
FIG. 9 is a partially exploded isometric view of the a portion of a fifth bowstring release mechanism connectable to the universal wrist strap via the mounting assembly in accordance with the invention.

Referring now to FIG. 9, a prior art connecting member 130 associated with a bowstring release mechanism, such as mechanism 14 in FIG. 1, is connected to the wrist strap 12 in accordance with the invention. As shown, the connecting member 130 is generally triangular in shape and formed as a flat plate with a transverse slot 132 that forms a rearward transverse arm 134. A forward aperture 136 extends through the connecting member 130 for connection to an extension member (not shown) associated with the release mechanism in a well-known manner. When the connecting member 116 is installed on the wrist strap 12, the rearward transverse arm 134 is received in the locating groove 74 of the lower mounting member 54 while the transverse slot 132 captures the front wall 70 thereof. In this position, the resilient locating pins 78 press against the rearward transverse arm 134, forcing it against the front wall 70 to thereby reduce or prevent vibration and/or rattling of the connecting member 130 during use. The upper mounting portion 56 is then secured to the lower mounting portion 54, as previously described, so that the rearward transverse arm 134 is captured between the forward ends of the first and second upper mounting blocks 94 and 96 and the front wall 70, as well as the lower plate 55 and upper plate 92. In this manner, the prior art connecting member 130 and its associated extension member and/or string release mechanism can be re-used when the user's worn or broken wrist strap is replaced with the wrist strap 12 or the like having the mounting assembly 16. When the connecting member 130 is installed on the lower mounting portion 54 as shown, neither the lower mounting block 64 nor the strap connecting slots 80, 82, and 84, are used for retaining the connecting member 130 for the purpose of connecting the connecting member 130 to the wrist strap 12.

Figure 10:
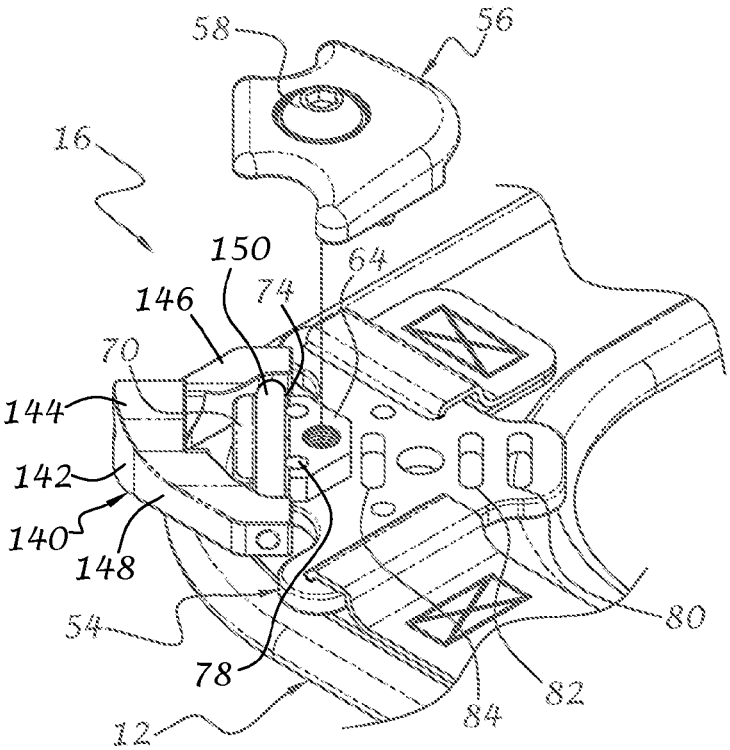
FIG. 10 is a partially exploded isometric view of the a portion of a sixth bowstring release mechanism connectable to the universal wrist strap via the mounting assembly in accordance with the invention.

Referring now to FIG. 10, a prior art connecting member 140 associated with a bowstring release mechanism, such as mechanism 14 in FIG. 1, is connected to the wrist strap 12 in accordance with the invention. As shown, the connecting member 140 includes a yoke 142 with a center mount 144 for connection to an extension member (not shown) associated with the release mechanism in a well-known manner. Legs 146 and 148 extend rearwardly and outwardly from either side of the center mount 144. A rearward transverse rod or arm 150 extends between the outer free ends of the legs. When the connecting member 140 is installed on the wrist strap 12, the rearward transverse arm 150 is received in the locating groove 74 of the lower mounting member 54 while an opening 152 formed between the legs 146, 148 and the arm 150 captures the front wall 70 thereof. In this position, the resilient locating pins 78 press against the rearward transverse arm 150, forcing it against the front wall 70 to thereby reduce or prevent vibration and/or rattling of the connecting member 140 during use. The upper mounting portion 56 is then secured to the lower mounting portion 54, as previously described, so that the rearward transverse arm 150 is captured between the forward ends of the first and second upper mounting blocks 94 and 96 and the front wall 70, as well as the lower plate 55 and upper plate 92. In this manner, the prior art connecting member 140 and its associated extension member and/or string release mechanism can be re-used when the user's worn or broken wrist strap is replaced with the wrist strap 12 or the like having the mounting assembly 16. When the connecting member 140 is installed on the lower mounting portion 54 as shown, the strap connecting slots 80, 82, and 84, will not be used for retaining the connecting member 140 for the purpose of connecting the connecting member 140 to the wrist strap 12.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, the wrist strap 12 can be of any style or type with a variety of different securing means, as long as the mounting assembly 16 is connected thereto. Moreover, it will be understood that the particular shape and features of the mounting assembly can vary depending on the types of connecting members to be connected thereto. It will be understood, therefore, that the present invention is not limited to the particular embodiments disclosed, but also covers modifications within the spirit and scope of the invention as defined by the appended claims.

What is claimed is:

1. A universal wrist strap for connection to a plurality of different bowstring release mechanisms via a plurality of different connecting members, the wrist strap comprising:

a flexible base member adapted to fit around the wrist of a user, the flexible base member having a connection area; and a mounting assembly connected to the connection area, the mounting assembly including first and second features for respectively receiving and retaining at least first and second connecting members of the plurality of different connecting members.

2. A universal wrist strap according to claim 1, wherein the mounting portion comprises a lower mounting portion having the first feature for retaining the first of the plurality of connecting members and the second feature for retaining the second of the plurality of connecting members.

3. A universal wrist strap, for connection to a plurality of different bowstring release mechanisms via a plurality of different connecting members, the wrist strap comprising:

a flexible base member adapted to fit around the wrist of a user, the flexible base member having first and second arms that converge towards a connection area; and a mounting assembly connected to the connection area and being adapted to receive and retain the plurality of different connecting members, the mounting assembly including a lower mounting portion having at least a first feature for retaining a first of the plurality of connecting members;

wherein the lower mounting portion further comprises at least a second feature for retaining at least a second of the plurality of connecting members.

4. A universal wrist strap according to claim 3, wherein the lower mounting portion further comprises at least a third feature for retaining at least a third of the plurality of connecting members.

5. A universal wrist strap according to claim 4, wherein the first and second features together are arranged to receive the first connecting member but not the second connecting member different from the first connecting member; and further wherein the second feature together with the third feature are arranged to receive the second connecting member but not the first connecting member.

6. A universal wrist strap according to claim 5, wherein the mounting assembly further comprises an upper mounting portion connectable to the lower mounting portion, such that the connecting members are captured therebetween.

7. A universal wrist strap according to claim 6, wherein the upper mounting portion comprises at least a fourth feature that cooperates with at least one of the first, second and third features of the lower mounting portion for capturing at least the first, second, and third connecting members.

8. A universal wrist strap for connection to a plurality of different bowstring release mechanisms via a plurality of different connecting members, the wrist strap comprising:

a flexible base member adapted to fit around the wrist of a user, the flexible base member having first and second arms that converge towards a connection area; and a mounting assembly connected to the connection area and being adapted to receive and retain the plurality of different connecting members, the mounting assembly including a lower mounting portion having at least a first feature for retaining a first of the plurality of connecting members;

wherein the mounting assembly further comprises an upper mounting portion connectable to the lower mounting portion, such that the connecting members are captured therebetween.

9. A universal wrist strap according to claim 8, wherein the lower mounting portion and upper mounting portion comprise cooperating features for capturing the plurality of different connecting members.

10. A universal wrist strap for connection to a plurality of different bowstring release mechanisms via a plurality of different connecting members, the wrist strap comprising:

a flexible base member adapted to fit around the wrist of a user, the flexible base member having first and second arms that converge towards a connection area; and a mounting assembly connected to the connection area and being adapted to receive and retain the plurality of different connecting members, wherein the mounting assembly includes a lower mounting portion comprising:

a lower plate attached to the wrist strap;

a forward wall extending upwardly from the lower plate;

a mounting block spaced from the forward wall and extending upwardly from the lower plate; and a connecting groove located between the forward wall and mounting block;

wherein the forward wall and mounting block are arranged to receive a first connecting member but not a second connecting member different from the first connecting member; and further wherein the forward wall and the connecting groove are arranged to receive the second connecting member but not the first connecting member.

11. A universal wrist strap according to claim 10, wherein the lower mounting portion further comprises a plurality of slots for receiving a third connecting member different from the first and second connecting member.

12. A universal wrist strap according to claim 11, wherein the mounting assembly further comprises an upper mounting portion connectable to the lower mounting portion, such that the first and second connecting members are captured therebetween.

13. A universal wrist strap according to claim 12, wherein the upper mounting portion comprises:

an upper plate; and at least one upper mounting block that cooperates with the lower mounting block to capture at least the first connecting member therebetween.

14. A universal wrist strap according to claim 10, wherein the mounting assembly further comprises an upper mounting portion connectable to the lower mounting portion, such that the first and second connecting members are captured therebetween.

15. A universal wrist strap according to claim 14, wherein the upper mounting portion comprises:

an upper plate; and at least one upper mounting block that cooperates with the lower mounting block to capture at least the first connecting member therebetween.

16. A method of replacing a worn or broken wrist strap of a bowstring release assembly having a bowstring release mechanism adapted to receive, retain, and release a bowstring, and a connecting member for connecting the bowstring release mechanism to the wrist strap, the method comprising:

providing a universal wrist strap with a mounting assembly having an upper mounting portion connectable to a lower mounting portion;

removing the connecting member and bowstring release mechanism from the worn or broken wrist strap;

installing the connecting member on the lower mounting portion; and connecting the upper mounting portion to the lower mounting portion such that the connecting member is captured and retained in the mounting assembly.

17. A method according to claim 16, and further comprising providing a plurality of different mounting features on the lower mounting portion such that the lower mounting portion is capable of receiving connecting members having different configurations.

18. A method according to claim 17, and further comprising providing at least one upper mounting feature that cooperates with at least one of the lower mounting features for capturing a plurality of the connecting members having different configurations.

* * * * *